US009835054B2

(12) United States Patent
Weber et al.

(10) Patent No.: US 9,835,054 B2
(45) Date of Patent: Dec. 5, 2017

(54) EXHAUST GAS TURBOCHARGER

(71) Applicant: Bosch Mahle Turbo Systems GmbH & Co. KG, Stuttgart (DE)

(72) Inventors: Friedemann Weber, Erbstetten (DE); Thomas Berger, Ditzingen (DE); Thanh-Hung Nguyen-Schaefer, Asperg (DE); Christoph Butscher, Leonberg (DE); Jasmin Hausser, Fellbach (DE); Andreas Fath, Bietigheim-Bissingen (DE)

(73) Assignee: Bosch Mahle Turbo Systems GmBH & Co. KG (DE)

( * ) Notice: Subject to any disclaimer, the term of this patent is extended or adjusted under 35 U.S.C. 154(b) by 685 days.

(21) Appl. No.: 14/185,663

(22) Filed: Feb. 20, 2014

(65) Prior Publication Data

US 2014/0234075 A1 Aug. 21, 2014

(30) Foreign Application Priority Data

Feb. 21, 2013 (DE) ..... 10 2013 202 841

(51) Int. Cl.
*F01D 17/12* (2006.01)
*F01D 25/18* (2006.01)
*F01D 11/02* (2006.01)

(52) U.S. Cl.
CPC ..... *F01D 25/186* (2013.01); *F01D 11/02* (2013.01); *F05D 2220/40* (2013.01)

(58) Field of Classification Search
CPC ..... F04D 29/464; F02C 6/12; F01D 25/00; F01D 25/125; F01D 25/18
USPC ..... 415/157
See application file for complete search history.

(56) References Cited

U.S. PATENT DOCUMENTS 8,398,363 B2 * 3/2013 Mundinger ..... F01D 25/16 415/111
2007/0092387 A1 4/2007 Ward
2010/0139270 A1 * 6/2010 Koch ..... F01D 25/16 60/605.3

FOREIGN PATENT DOCUMENTS

DE 1400440 U 4/1969
DE 102010025614 A1 1/2012
DE WO 2012000586 A1 * 1/2012 ..... F01D 25/16
JP 2004-132319 A 4/2004

(Continued)

OTHER PUBLICATIONS

English abstract for DE-102013202841.5 dated Oct. 18, 2013.
English abstract for JP2004-132319.

*Primary Examiner* — Craig Kim
*Assistant Examiner* — Jason Mikus
(74) *Attorney, Agent, or Firm* — Fishman Stewart PLLC

(57) ABSTRACT

An exhaust gas turbocharger may include a shaft mounted in a bearing housing carrying a compressor wheel and a turbine wheel. The shaft may include a sealing bush arranged on the shaft in a rotationally fixed manner. The sealing bush together with a bearing housing cover may at least partially delimit an annular oil centrifuging space arranged coaxially to the sealing bush. The bearing housing cover may include a guiding nib located radially outside the sealing bush partially covering the sealing bush in axial direction. The guiding nib may be configured to guide oil separated in the oil centrifuging space onto the rotating sealing bush. The rotating sealing bush may be configured to direct the oil into the oil centrifuging space in response to centrifugal force creating an oil swirl.

19 Claims, 2 Drawing Sheets

(56) References Cited

FOREIGN PATENT DOCUMENTS

| | | | |
|---|---|---|---|
| WO | WO-2008/042698 | A1 | 4/2008 |
| WO | WO-2013/106303 | A1 | 7/2013 |

* cited by examiner

EXHAUST GAS TURBOCHARGER

CROSS-REFERENCE TO RELATED APPLICATIONS

This application claims priority to German Patent Application Number 10 2013 202 841.5, filed Feb. 21, 2013, which is hereby incorporated by reference in its entirety.

TECHNICAL FIELD

The present invention relates to an exhaust gas turbocharger with a shaft that is mounted in a bearing housing and carries a compressor wheel and a turbine wheel according to the preamble of claim 1. The invention additionally relates to an internal combustion engine equipped with such an exhaust gas turbocharger.

BACKGROUND

Emission legislation that is steadily becoming more stringent both for on-highway as well as for off-highway applications is characterized by a clear reduction of the particle emissions. The particle emissions of the internal combustion engines also include the oil that is combusted in the internal combustion engine, which in addition to the blowby from the crankcase is also created through the design-related oil leakage of the exhaust gas turbocharger. Reliable oil sealing thus becomes ever more important. Popular oil seals in this case usually have the following features: use of at least one, maximally two shaft sealing rings between sealing bush and bearing housing cover, minimisation of the axial gaps between bearing housing cover, sealing bush, axial bearing and thrust washer, provision of oil baffle plates, which prevent oil entering a region between sealing bush and bearing housing cover and provision of an undercut in the bearing housing cover, which collects the spun-off oil, returning it into an oil reservoir of the bearing housing through a circumferential groove.

From US 2007/0092387 A1 a generic internal combustion engine with a shaft that is mounted in a bearing housing and carries a compressor wheel as well as a turbine wheel is known, wherein for sealing the bearing housing with respect to the compressor side, a sealing bush that is arranged on the shaft in a rotationally fixed manner is provided, which together with the bearing housing cover at least partially delimits an annular oil centrifuging space that is arranged coaxially to the sealing bush. The bearing housing cover in this case has an outer wall and an inner wall that is formed collar-like, which serves for collecting the separated oil and serves for passing on said oil as far as to an outlet opening on the bottom side. By way of this outlet opening or outflow opening, the oil that is separated in the oil centrifuging space and collected is returned to an oil reservoir.

From WO 2008/042698 A1 a further generic exhaust gas turbocharger with a shaft mounted in a bearing housing is known, wherein for sealing the shaft with respect to the compressor side, a sealing bush that is connected to the shaft in a rotationally fixed manner is provided, which interacts with a bearing housing cover. Here, the bearing housing cover in turn is designed in such a manner that it passes the oil that is separated in the oil centrifuging space to an oil drain on the bottom side.

SUMMARY

The present invention deals with the problem of stating an improved embodiment for an exhaust gas turbocharger of the generic type, which is characterized in particular through improved oil sealing.

According to the invention, this problem is solved through the subjects of the independent claims. Advantageous embodiments are subject of the dependent claims.

The present invention is based on the general idea of providing a guiding nib on a bearing housing cover of an exhaust gas turbocharger, which again feeds oil spun off and collected in an oil centrifuging space to a sealing bush that is rotating and connected to a shaft of the exhaust gas turbocharger in a rotationally fixed manner so that from there it is again spun off into the oil centrifuging space and because of this an oil swirl is created. The exhaust gas turbocharger according to the invention comprises a shaft that is mounted in a bearing housing and carries a compressor wheel and a turbine wheel, wherein the previously mentioned sealing bush is arranged on the shaft in a rotationally fixed manner. Together with the bearing housing cover, the sealing bush at least partially delimits an annular oil centrifuging space that is arranged coaxially to the sealing bush, in which oil spun away from the sealing bush is collected. This spun-off or spun-away oil now runs towards the guiding nib described before because of gravity, which guiding nib is arranged on the bearing housing cover radially outside the sealing bush and at the same time at least partially covers the sealing bush in axial direction, so that the oil returned from or dripping off the guiding nib directly strikes a cylindrical surface of the sealing bush, from where it is spun back into the oil centrifuging space because of the centrifugal force. Above the shaft, the drainage function created by the guiding nib in this case functions through the gravity of the oil drops. The centrifuging action of the sealing bush in this case is created through the centrifugal forces. When the oil dripping from the guiding nib onto the sealing bush is spun back, two oil guiding paths are generally created, namely a coaxially and annularly designed first oil guiding path, whose axis is identical to the shaft axis, and a second oil guiding path, whose axis runs orthogonally to the shaft axis and because of this creates the swirling movement in the oil centrifuging space. The oil centrifuging space itself is delimited by an axial bearing, the bearing housing cover and the sealing bush, wherein the chamfer on the sealing bush facing the axial bearing is arranged or designed so that the oil droplets striking said sealing bush can be freely spun off into the oil centrifuging space. The chamfer of the sealing bush, i.e. of its cylindrical surface, thus tapers conically away from an adjacent compressor wheel, just like the guiding surface of the guiding nib facing the oil centrifuging space is likewise formed parallel to the chamfer on the sealing bush. Generally, the guiding nib can obviously be also designed wedge-like and because of this have a lower side that is opposite to the guiding surface. Should oil thus get under the guiding nib, oil droplets entering there collect on the side facing gravity and can drain off into an oil reservoir on the lower side via a drainage opening. The outer diameter of the sealing bush in this case should preferably be selected large in order to be able to achieve maximum centrifugal force acting on the oil droplets. The guiding nib is generally formed annular in shape and above the shaft brings about the oil being fed onto the sealing bush and, below the shaft, drainage of the collected oil into the oil reservoir via the drainage opening.

In an advantageous further development of the solution according to the invention, the bearing housing cover and the sealing bush together form a comb-like labyrinth seal acting in radial direction, which comprises at least one tooth, preferentially even at least two teeth. The labyrinth seal, which in particular comprises two teeth engaging into one another, in this case intercepts the oil which from the oil centrifuging space via the lower side of the guiding nib enters a space between guiding nib and sealing bush. In this case, the oil that has entered here can collect in each channel of the labyrinth seal and is discharged downwards in the direction of gravity. This effect is additionally favoured in this case through the rotatoric movement of the oil droplets between the bearing housing cover and the sealing bush. A further effect favouring the reduction of the oil is a pressure difference which is created through the different cross-sectional profiles. The labyrinth seal in this case consists of for example two combs running within one another, wherein the bearing housing cover forms a fixed contour, while the rotating sealing bush provides the mating contour meshing therewith. Both contours in this case are located at a defined spacing from one another, which forms a channel through which the oil droplets can flow both in circumferential direction as well as in radial direction. Through their meander shape, the individual teeth of the combs enlarge the surface that is wetted by the oil and thereby increase the shearing action, which is created through the relative speed between the stationary bearing housing cover and the rotating sealing bush. The consequence of this is a clearly improved barrier effect in the direction of the shaft sealing rings arranged between the bearing housing cover and the sealing bush. A comb-like labyrinth seal in this case can also be formed with merely one tooth, as a result of which the radial installation space is reduced. Through at least two teeth arranged in radial direction and engaging into one another the sealing effect can be improved but the required installation space is increased as well. For a very particularly simple configuration omitting the labyrinth seal is also possible, wherein such a concept is particularly suitable for the use of small exhaust gas turbochargers, such as are utilised during extreme downsizing for example in the case of spark-ignition engines with for example three cylinders and a cubic capacity of less than one liter. These small exhaust gas turbochargers are characterized by a high rotational speed, which overcompensates for prevailing circumferential speed in the case of smaller outer diameters because of the greater shearing effect as a consequence of the greater relative speed between rotating sealing bush and stationary bearing housing cover. In the case of such an exhaust gas turbocharger, the sealing function is exclusively realised via the guiding nib and the two oil guiding paths.

Practically, the labyrinth seal is designed in such a manner that oil entering therein is foamed up because of the rotation of the sealing bush and in this way additionally creates a sealing effect or supports the sealing effect. Such foam formation constitutes a physical barrier effect which cannot be overcome by the oil entering the labyrinth seal or only with difficulty so.

Further important features and advantages of the invention are obtained from the subclaims, from the drawings and from the associated figure description with the help of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

Here it shows, in each case schematically.

DETAILED DESCRIPTION

Figure 1:
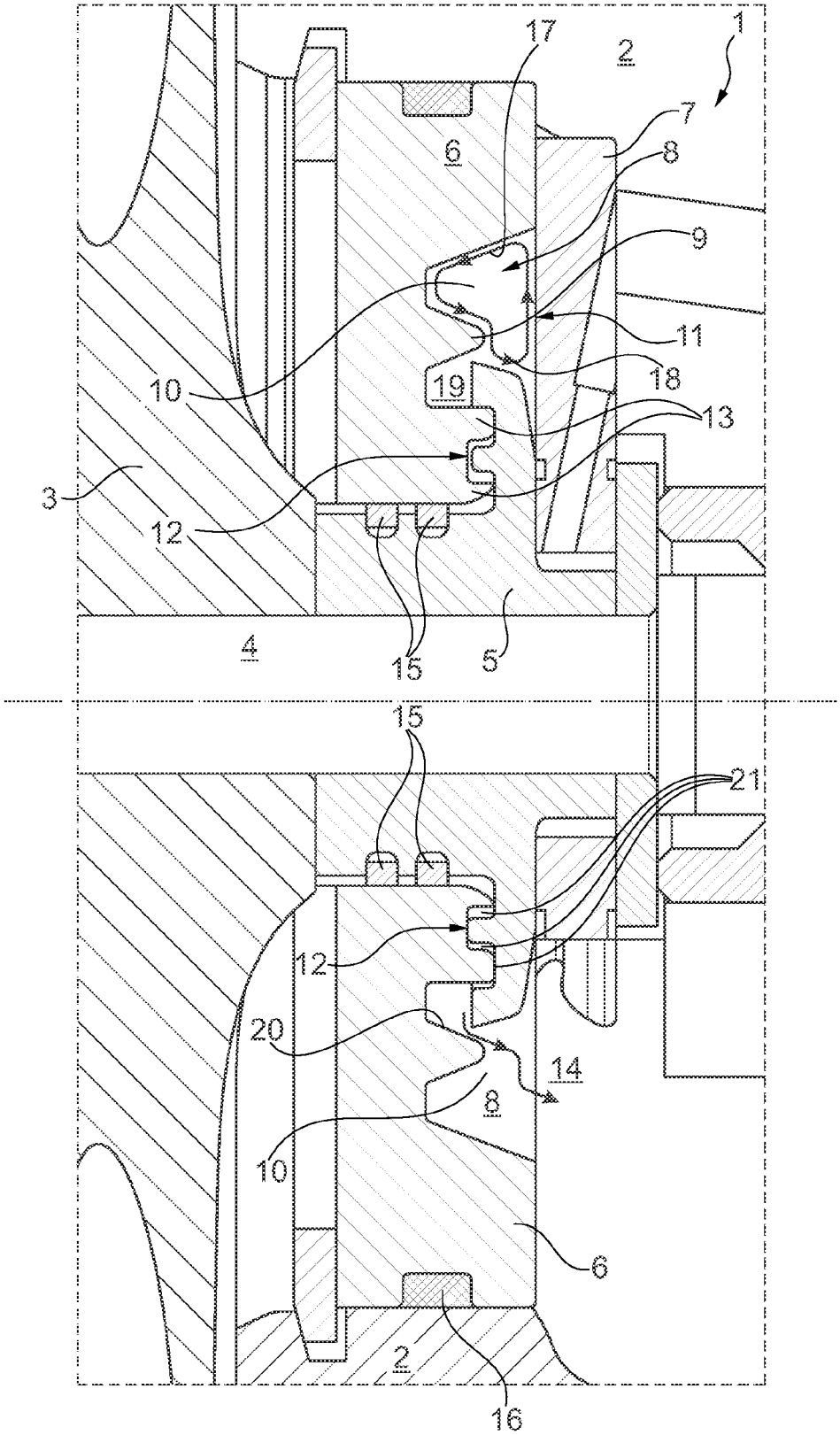
FIG. 1 a sectional representation through an exhaust gas turbocharger according to the invention, FIG. 2 a detail representation of a possible embodiment of the exhaust gas turbocharger according to the invention in the region of an oil centrifuging space, FIG. 3 an embodiment as in FIGS. 1 and 2, however with a labyrinth seal comprising merely one tooth, FIG. 4 an embodiment of the exhaust gas turbocharger according to the invention without labyrinth seal.
Figure 2:
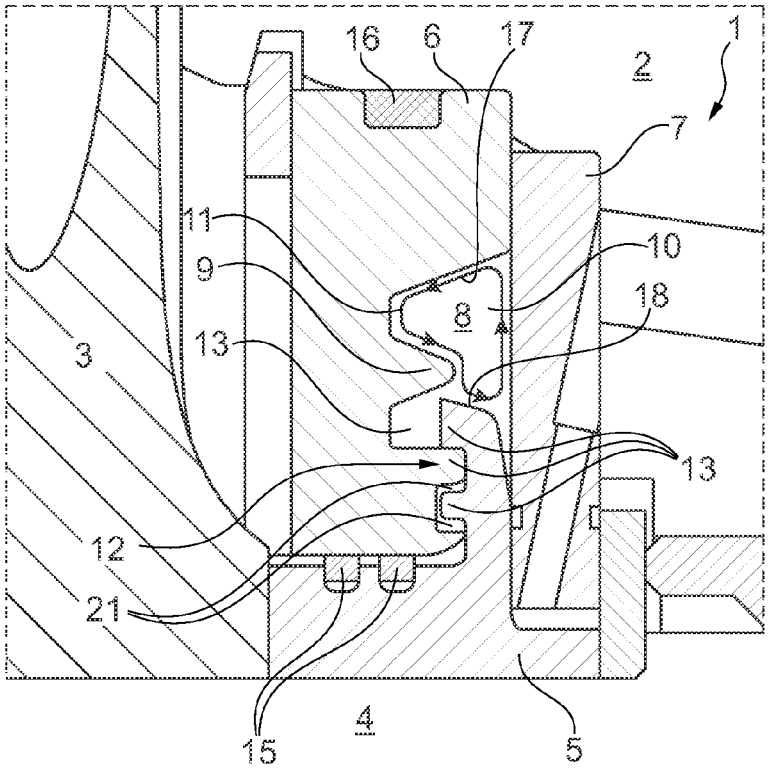

According to FIGS. 1 and 2, an exhaust gas turbocharger 1 according to the invention, which in general can also be formed as a charging device, comprises a shaft 4 that is mounted in a bearing housing 2 and carries a compressor wheel 3 and a turbine wheel which is not shown. Connected to the shaft 4 in a rotationally fixed manner is a sealing bush 5, which together with a bearing housing cover 6 and an axial bearing 7 delimits an annular oil centrifuging space 8 that is arranged coaxially to the sealing bush 5. According to the invention, the bearing housing cover 6 now comprises a guiding nib 9 located radially outside the sealing bush 5 and partially covering the latter in axial direction, which guides the oil that is separated or spun-off in the oil centrifuging space 8 onto the rotating sealing bush 5, from where because of the centrifugal force it is again spun off the sealing bush 5 into the oil centrifuging space 8 and thus creates an oil swirl with at least two oil guiding paths 10 and 11. The first oil guiding path 10 in this case runs annularly about the shaft 4, i.e. according to FIG. 1 in each case perpendicularly to the figure plane, whereas the second oil guiding path 11 creates the shown oil swirl. The guiding nib 9 in this case is wedge-shaped.

Figure 3:
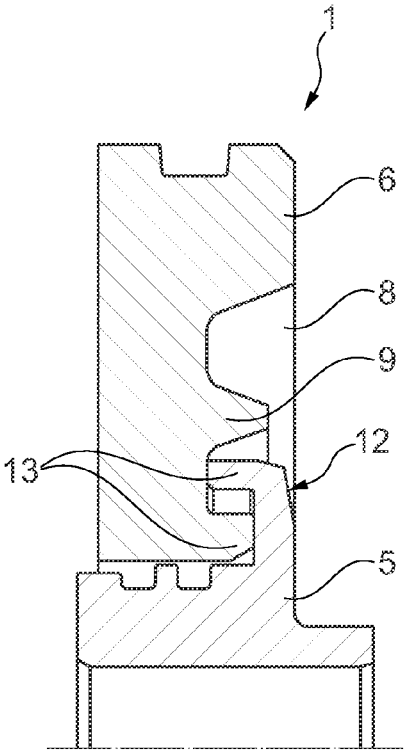

In addition, the bearing housing cover 6 and the sealing bush 5 form a comb-labyrinth seal 12 acting with one another in radial direction, which comprises at least one tooth 13 (see FIG. 3), but preferentially even two teeth 13 (see FIGS. 1 and 2). Purely theoretically an embodiment without any such labyrinth seal 12 is obviously also possible, such as is shown according to FIG. 4. Such an embodiment without labyrinth seal 12 is possible with small exhaust gas turbochargers 1, in particular with extreme downsizing. An embodiment of the labyrinth seal 12 with merely one tooth 13 according to the invention makes possible a comparatively compact design, so that such an embodiment of the exhaust gas turbocharger is employed in particular when the installation space is limited in particular in radial direction, so that an embodiment of the labyrinth seal 12 with two teeth 13 radially in succession would not be possible. In general, the labyrinth seal 12, if indeed present, is preferably designed in such a manner that oil entering therein is foamed up because of the rotation of the sealing bush 5 and thus additionally forms a barrier which supports the sealing effect or creates an additional sealing effect. The oil centrifuging space 8 in this case is delimited by the sealing bush 5, the bearing housing cover 6 and the axial bearing 7 according to the FIGS. 1 and 2.

Considering FIG. 1 and here specifically the lower part, it is evident that the bearing housing 2 or the axial bearing 7 on its wall delimiting the oil centrifuging space 8 has an opening 14 on the lowermost point, via which separated oil can flow back into an oil reservoir which is not shown. Here, the opening 14 according to FIG. 1 is located in the section plane. The bearing housing cover 6 is sealed relative to the sealing bush 5 via shaft sealing rings 15 and relative to the bearing housing 2 via a sealing ring 16. With the shaft sealing rings 15, the sealing ring 16 and the guiding nib 9 or the labyrinth seal 12, an optimum sealing effect can be achieved which preferentially entirely prevents oil lubricating the shaft 4 penetrating the compressor side, i.e. towards the compressor wheel 3, thus meeting even most stringent emission laws.

Considering FIGS. 1 to 4 it is evident that an outer wall 17 of the oil centrifuging space 8 conically tapers in the direction of the compressor wheel 3, as a result of which feeding of the oil that is separated in the oil centrifuging space 8 towards the guiding nib 9 and from the latter to a chamfer 18 of the sealing bush 5 can be brought about. Thus, when the oil droplets spun off into the oil centrifuging space 8 strike the outer wall 17 which tapers in the direction of the compressor wheel 3, they run down on the latter in the direction of the guiding nib 9, which likewise has an incline, because of their gravity. This incline ensures that the oil is diverted from the guiding nib 9 in the direction of the rotating sealing bush 5. Then, the rotating sealing bush 5 again spins off the oil droplets from the guiding nib 9 striking the chamfer 18 of the sealing bush 5 in the direction of the oil centrifuging space 8 so that the cycle recommences. The guiding nib 9 in this case projects over the outer diameter of the sealing bush 5, so that entering of oil droplets in a space 19 between the bearing housing cover 6 and the sealing bush 5 can be almost excluded.

The alignment of the chamfer 18 on the sealing bush 5 in this case is arranged so that the oil droplets are freely spun off into the oil centrifuging space 8. Should oil nevertheless reach the space 19 below the guiding nib 9, the oil droplets collect on a side facing gravity and can drain in the direction of the opening 14 on a lower side 20 of the guiding nib 9. Any oil that could not be collected and because of this discharged up to that point is intercepted by the labyrinth seal 12 both in axial as well as in radial direction. Here, the oil can also collect in any channel and be discharged downwards in the direction of the opening 14 in the direction of gravity of the oil. This effect is additionally favoured through the rotatoric movement of the oil droplets of the bearing housing cover 6 and the sealing bush 5. A further effect favouring the reduction of oil penetration is a pressure difference, which is created through different cross-sectional profiles. The outer diameter of the sealing bush 5 is preferentially selected as large as possible in order to achieve maximum centrifugal force acting on the oil droplets.

Looking again at the individual teeth 13 of the labyrinth seal 12, it is evident that these do not engage into the recesses of the labyrinth seal 12 located opposite in an accurately fitting manner but are located at a defined spacing from one another, which forms a channel 21 through which the oil droplets can flow both in circumferential direction as well as in radial direction. One or two teeth 13 in this case is to mean the teeth 13 which are arranged on a common component, for example the bearing housing cover 6 or the sealing bush 5, so that a labyrinth seal 12 with two teeth 13 on the sealing bush 5 obviously also comprises two recesses or teeth 13 on the bearing housing cover 6 located opposite, which in turn are located opposite the associated recesses in the bearing housing cover 6.

In a reduced form, the labyrinth seal 12 can also be designed with merely one tooth 13 (see FIG. 3), wherein in this case the tooth 13 is formed through an outer contour of the sealing bush 5. In axial direction it is embodied longer than in the case of the labyrinth seal 12 according to the FIGS. 1 and 2, in order to at least partially compensate for the absence of the second tooth 13. This concept is important in particular for small exhaust gas turbochargers 1, which because of the installation space limitation does not allow any space for a labyrinth seal 12 is constructed larger in radial direction.

Figure 4:
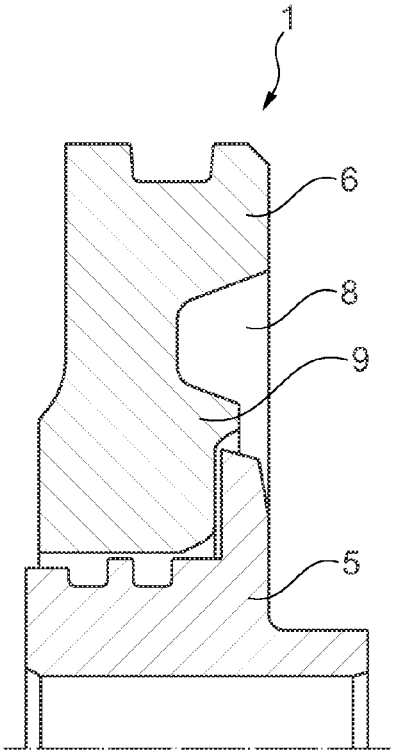

Considering the exhaust gas turbocharger 1 according to FIG. 4, a version that is even more simplified is depicted, in which as oil sealing element exclusively the guiding nib 9 remains. The sealing function in this case is exclusively realised via the two oil guiding paths 10 and 11 (see FIG. 1). The advantage of this concept in this case is constituted in the simple geometry of the sealing components and the associated low manufacturing costs.

In addition, this concept is suitable for use of particularly small exhaust gas turbochargers 1, such as are employed for extreme downsizing, for example for spark ignition engines with three cylinders and a cubic capacity of less than one liter. These small exhaust gas turbochargers 1 are characterized by a high rotational speed, which overcompensates for the circumferential speed that prevails in the case of smaller outer diameters because of the greater shearing effect as a consequence of the greater relative speed between rotating sealing bush and stationary bearing housing cover.

The exhaust gas turbocharger 1 according to the invention thus makes possible yet a further significant reduction of particle emission and thus adherence to most stringent emission values.

The invention claimed is:

1. An exhaust gas turbocharger, comprising:

a shaft having a rotation axis mounted in a bearing housing carrying a compressor wheel and a turbine wheel, wherein the shaft includes a sealing bush arranged on said shaft in a rotationally fixed manner, the sealing bush together with a bearing housing cover at least partially delimits an annular oil centrifuging space arranged coaxially to the sealing bush;

wherein the bearing housing cover includes a guiding nib located radially outside the sealing bush and partially covering the sealing bush in an axial direction, and the sealing bush has a radially outer surface facing towards the guiding nib, the outer surface defining a sloping face that conically tapers in a direction away from the compressor wheel and extends radially inwards;

wherein the guiding nib is configured to guide oil separated in the oil centrifuging space onto the sealing bush during rotation of the shaft, and the sealing bush is configured to direct the oil back into the oil centrifuging space during rotation of the shaft to facilitate an oil swirl; and wherein the guiding nib has a guide surface defining an incline facing the oil centrifuging space and a radially inner surface facing towards the shaft, and wherein the incline extends an entire length of the guide surface along the axial direction to partially cover the sealing bush and extends at least partially parallel to the sloping face of the sealing bush.

2. The exhaust gas turbocharger according to claim 1, wherein the guiding nib is wedge-shaped.

3. The exhaust gas turbocharger according to claim 1, wherein the bearing housing cover and the sealing bush together form a comb-like labyrinth seal acting in a radial direction.

4. The exhaust gas turbocharger according to claim 3, wherein the comb-like labyrinth seal includes at least one tooth on the sealing bush and the bearing housing cover.

5. The exhaust gas turbocharger according to claim 3, wherein the labyrinth seal is configured to facilitate relative rotation between the bearing housing cover and the sealing bush to foam oil entering therein during rotation of the sealing bush.

6. The exhaust gas turbocharger according to claim 1, wherein the oil centrifuging space is delimited by an axial bearing, the bearing housing cover and the sealing bush.

7. The exhaust gas turbocharger according to claim 6, wherein the axial bearing on a wall delimiting the oil centrifuging space has an opening on a lowermost point, via which separated oil can flow into an oil reservoir.

8. The exhaust gas turbocharger according to claim 1, wherein the bearing housing cover with respect to the sealing bush is sealed via a shaft sealing ring and relative to the bearing housing via a sealing ring.

9. The exhaust gas turbocharger according to claim 1, further comprising an outer wall of the oil centrifuging space conically tapers in a direction of the compressor wheel.

10. The exhaust gas turbocharger according to claim 3, wherein the comb-like labyrinth seal includes at least two teeth on the sealing bush and the bearing housing.

11. The exhaust gas turbocharger according to claim 3, wherein the comb-like labyrinth seal is disposed radially inward of the guiding nib.

12. The exhaust gas turbocharger according to claim 1, wherein the outer surface of the sealing bush includes a chamfer facing away from the compressor wheel, the chamfer extending radially inwards and at least partially defining the sloping face extending parallel to the guide surface of the guiding nib.

13. The exhaust gas turbocharger according to claim 1, wherein the guiding nib protrudes axially from the bearing housing cover and conically tapers away from the compressor wheel via the guide surface and the radially inner surface.

14. The exhaust gas turbocharger according to claim 1, further comprising a comb-like labyrinth seal disposed radially between the guiding nib and a portion of the sealing bush, wherein the labyrinth seal includes a first toothed contour mating with a second toothed contour.

15. The exhaust gas turbocharger according to claim 14, wherein the first toothed contour is defined by the bearing housing cover and the second toothed contour is defined by the sealing bush.

16. An exhaust gas turbocharger, comprising:

a shaft having a rotation axis mounted in a bearing housing;

a wheel disposed on an end of the shaft;

a sealing bush arranged coaxially and rotationally fixed on the shaft, the sealing bush having a radially extending portion projecting away from the shaft defining an outer circumferential surface;

a bearing housing cover arranged axially between the wheel and the radially extending portion of the sealing bush, wherein the bearing housing cover together with the sealing bush at least partially delimits an annular oil centrifuging space disposed coaxially with the sealing bush;

a guiding nib disposed on the bearing housing cover radially outside the outer circumferential surface of the sealing bush, the guiding nib projecting axially from the bearing housing cover and partially covering the outer circumferential surface of the sealing bush in an axial direction; and wherein the guiding nib conically tapers away from the wheel and defines an inclined surface facing towards the centrifuging space for guiding oil to the outer circumferential surface of the sealing bush, and wherein the inclined surface extends an entire length of the guiding nib facing towards the centrifuging space in the axial direction to the outer circumferential surface of the sealing bush.

17. The exhaust gas turbocharger according to claim 16, wherein the outer circumferential surface of the sealing bush includes a chamfer conically tapering radially inwards in a direction away from the wheel to facilitate an oil swirl together with the guiding nib.

18. The exhaust gas turbocharger according to claim 17, wherein the chamfer extends parallel to the inclined surface of the guiding nib.

19. The exhaust gas turbocharger according to claim 16, further comprising a labyrinth seal disposed radially inwards of the guiding nib, the labyrinth seal including a first tooth disposed on the bearing housing cover mating with a second tooth disposed on the sealing bush.

* * * * *